US011519640B2

(12) United States Patent
Lee et al.

(10) Patent No.: US 11,519,640 B2
(45) Date of Patent: Dec. 6, 2022

(54) AIR CONDITIONER

(71) Applicant: LG ELECTRONICS INC., Seoul (KR)

(72) Inventors: Jisung Lee, Seoul (KR); Yongcheol Sa, Seoul (KR); Chiwoo Song, Seoul (KR); Ilyoong Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 85 days.

(21) Appl. No.: 17/108,423

(22) Filed: Dec. 1, 2020

(65) Prior Publication Data

US 2021/0199349 A1 Jul. 1, 2021

(30) Foreign Application Priority Data

Dec. 26, 2019 (KR) ..... 10-2019-0175647

(51) Int. Cl.
*F25B 5/02* (2006.01)
*F25B 41/22* (2021.01)

(52) U.S. Cl.
CPC ..... *F25B 5/02* (2013.01); *F25B 41/22* (2021.01)

(58) Field of Classification Search
CPC ..... F25B 5/02; F25B 41/20–28; F25B 2313/0232–02323; F25B 2400/04; F25B 2400/0401; F25B 2400/0403; F25B 2400/0409; F25B 2600/2501
See application file for complete search history.

(56) References Cited

U.S. PATENT DOCUMENTS 8,733,120 B2 * 5/2014 Morimoto ..... F25B 13/00 62/509
9,032,747 B2 * 5/2015 Yamashita ..... F24F 3/065 62/185
9,513,036 B2 * 12/2016 Motomura ..... F25B 13/00
9,557,083 B2 * 1/2017 Azuma ..... F24F 11/70
2002/0069654 A1 * 6/2002 Doi ..... F25B 41/39 62/199

(Continued)

FOREIGN PATENT DOCUMENTS

EP 2 495 514 9/2012
EP 2 963 358 1/2016

(Continued)

OTHER PUBLICATIONS

International Search Report dated Feb. 16, 2021 issued in Application No. PCT/KR2020/015145.

(Continued)

*Primary Examiner* — Miguel A Diaz
(74) *Attorney, Agent, or Firm* — KED & Associates

(57) ABSTRACT

An air conditioner includes a bypass pipe connecting a first bypass branch of a first connection pipe, through which high-pressure refrigerant flows, with a second bypass branch of a third connection pipe, through which low-pressure refrigerant flows, to allow bypassing of high-pressure refrigerant in the first connection pipe to the third connection pipe, and a bypass valve mounted in the bypass pipe. During a cooling operation of an indoor unit, the bypass valve is opened to allow bypassing of high-pressure refrigerant of the first connection pipe to the third connection pipe.

19 Claims, 6 Drawing Sheets

(56) References Cited

U.S. PATENT DOCUMENTS

2012/0006050 A1* 1/2012 Takayama ..... F25B 13/00 165/96
2012/0118005 A1 5/2012 Yamashita et al.
2012/0131948 A1* 5/2012 Yamashita ..... F24F 3/06 62/513
2012/0198873 A1* 8/2012 Yamashita ..... F25B 13/00 62/160
2012/0198879 A1* 8/2012 Motomura ..... F25B 13/00 62/238.7
2012/0291472 A1* 11/2012 Morimoto ..... F25B 25/005 62/324.6
2014/0007607 A1* 1/2014 Tamura ..... F25B 13/00 62/324.6
2014/0260387 A1* 9/2014 Takenaka ..... F24F 3/065 62/205
2015/0176864 A1 6/2015 Yamashita et al.
2016/0209085 A1* 7/2016 Kim ..... F25B 13/00
2018/0222287 A1 8/2018 Mieda et al.
2018/0259218 A1* 9/2018 Song ..... F24D 5/12
2018/0347868 A1* 12/2018 Okano ..... F25B 5/02
2021/0199349 A1* 7/2021 Lee ..... F25B 41/22
2021/0199350 A1* 7/2021 Song ..... F25B 49/02
2021/0231317 A1* 7/2021 Kim ..... F25B 25/005

FOREIGN PATENT DOCUMENTS

JP 2013164238 A * 8/2013 ..... F25B 13/00
JP 5474050 4/2014
KR 10-2014-0139240 12/2014
KR 10-2015-0034027 4/2015
KR 20160091298 A * 8/2016
WO WO-2016194145 A1 * 12/2016 ..... F24F 11/89
WO WO-2020197052 A1 * 10/2020 ..... F24F 1/0063
WO WO-2021157820 A1 * 8/2021

OTHER PUBLICATIONS

European Search Report issued in Application No. 20212681.9 dated Apr. 23, 2021.

* cited by examiner

AIR CONDITIONER

CROSS-REFERENCE TO RELATED APPLICATION(S)

The present application claims priority under 35 U.S.C. 119 and 35 U.S.C. 365 to Korean Patent Application No. 10-2019-0175647, filed in Korea on Dec. 26, 2019, which is hereby incorporated by reference in its entirety.

BACKGROUND

1. Field

The present disclosure relates to an air conditioner.

2. Background

An air conditioner maintains air within a predetermined space at a suitable condition or temperature according to usage or purposes thereof. The air conditioner may include a compressor, a condenser, an expansion device or expander, and an evaporator, and may cool or heat the predetermined space by performing a refrigeration cycle of compression, condensing, expansion, and evaporation of refrigerant.

The predetermined space may be a place where the air conditioner is used (e.g., a home or office space). When the air conditioner performs a cooling operation, an outdoor heat exchanger provided in an outdoor unit may function as a condenser, and an indoor heat exchanger provided in an indoor unit may function as an evaporator. When the air conditioner performs a heating operation, the indoor heat exchanger may function as a condenser and the outdoor heat exchanger may function as an evaporator.

A type and amount of refrigerant used in the air conditioner has been limited and/or reduced according to recent environmental regulation policies. In order to reduce the amount of refrigerant used, technology implementing heat exchange between refrigerant and predetermined fluid has been proposed. As an example, the predetermined fluid may include water.

U.S. Patent Publication No. 2015/0176864 (published Jun. 25, 2015) discloses an air conditioner using heat exchange between refrigerant and water. The air conditioner includes a plurality of heat exchangers for heat exchange between refrigerant and water and two valve devices connected to a refrigerant path such that each heat exchanger functions as an evaporator or a condenser. The air conditioner may determine an operation mode (e.g., heating or cooling) of the heat exchanger through control of the valve device.

The air conditioner includes three pipes connecting an outdoor unit and a heat exchange device. The three pipes include a high-pressure gas pipe through which high-pressure gaseous refrigerant flows, a low-pressure gas pipe through which low-pressure gaseous refrigerant flows, and a liquid pipe through which liquid flows.

However, when a cooling operation is performed in such a structure having three pipes, refrigerant condensed in the outdoor unit may be introduced into the liquid pipe and evaporated in the heat exchanger, and the evaporated refrigerant may flow through the low-pressure gas pipe and flow into the outdoor unit. The refrigerant of the high-pressure gas pipe may remain in the high-pressure gas pipe and, if this state is maintained for a long time, liquid refrigerant may accumulate, and an amount of refrigerant circulated in the system may decrease, reducing cycle stability. In addition, in the case of a water pipe, a flow rate may become insufficient due to excessive use of a three-way valve having large pressure loss, controlling a water pipe valve during operation may become difficult.

The above references are incorporated by reference herein where appropriate for appropriate teachings of additional or alternative details, features and/or technical background.

BRIEF DESCRIPTION OF THE DRAWINGS

Embodiments will be described in detail with reference to the following drawings in which like reference numerals refer to like elements, and wherein.

DETAILED DESCRIPTION

Figure 1:
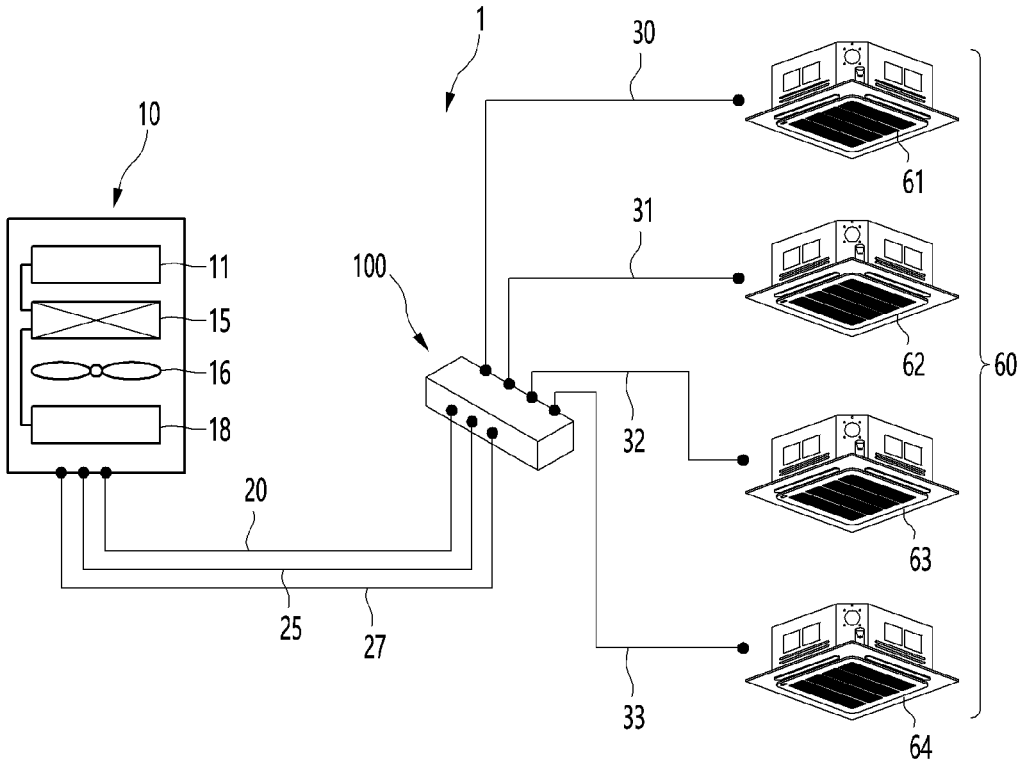
FIG. 1 is a schematic view showing an air conditioner according to an embodiment.
Figure 2:
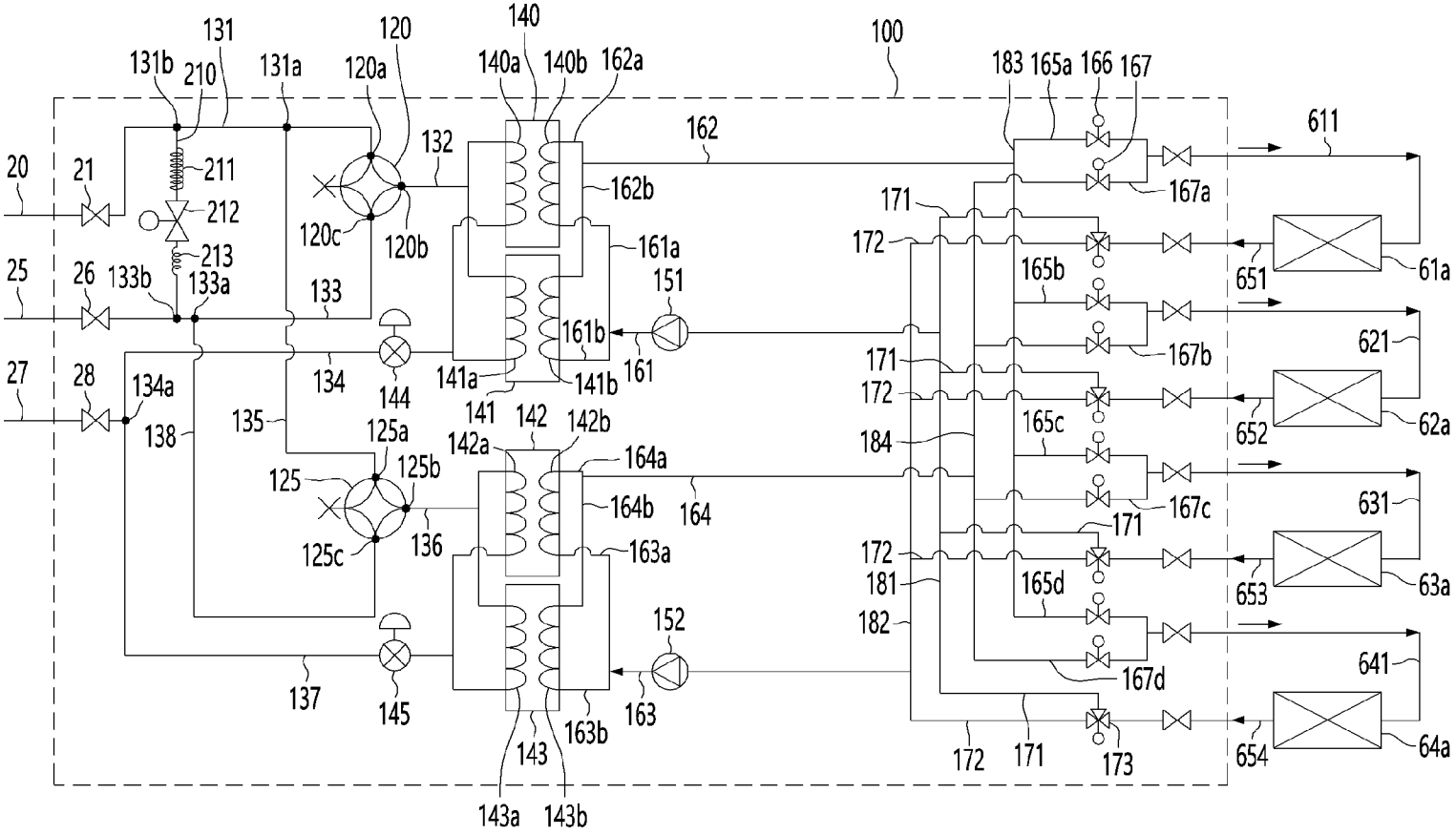
FIG. 2 is a cycle diagram showing a configuration of an air conditioner according to an embodiment.

Referring to FIGS. 1 and 2, an air conditioner 1 according to an embodiment may include an outdoor unit 10 provided in an outdoor space, at least one indoor unit 60 provided in an indoor space, and a heat exchange device 100 connected to the outdoor unit 10 and the indoor unit 60. The indoor unit 60 may include a plurality of indoor units 61, 62, 63, and/or 64. The heat exchange device 100 may be provided in an indoor space at a position close to the outdoor unit 10, but embodiments disclosed herein are not limited to a location of the heat exchange device 100.

The outdoor unit 10 may include a compressor 11 and an outdoor heat exchanger 15. The heat exchange device 100 may include at least one heat exchanger (140, 141, 142 and/or 143 in FIG. 2). The plurality of indoor units 61, 62, 63, and 64 may each include an indoor heat exchanger (61*a*, 62*a*, 63*a*, and 64*a* in FIG. 2). The heat exchange device 100 may alternatively be referred to as an intermediate heat exchange device or assembly, and the heat exchangers (140, 141, 142 and/or 143 in FIG. 2) of the heat exchange device 100 may alternatively be referred to as intermediate heat exchangers.

The outdoor unit 10 and the heat exchange device 100 may be fluidly connected by a first fluid. As an example, the first fluid may include refrigerant. The refrigerant may flow through a refrigerant path of the heat exchangers (140-143 and 15) provided in the heat exchange device 100 and the outdoor unit 10.

An outdoor fan 16 may be provided at a side of the outdoor heat exchanger 15 to blow outside air toward the outdoor heat exchanger 15. Heat exchange between the outside air and the refrigerant of the outdoor heat exchanger 15 may occur when the outdoor fan 16 is driven. The outdoor unit 10 may further include a main expansion valve (e.g., an electronic expansion valve or EEV) 18.

The air conditioner 1 may further include outdoor-unit connection pipes 20, 25 and 27 connecting the outdoor unit 10 with the heat exchange device 100. The outdoor-unit connection pipes 20, 25 and 27 may include a first outdoor-unit connection pipe or a high-pressure gas pipe 20 through which high-pressure gaseous refrigerant flows, a second outdoor-unit connection pipe or a low-pressure gas pipe 25 through which low-pressure gaseous refrigerant flows, and a third outdoor-unit connection pipe or liquid pipe 27 through which liquid refrigerant flows. The outdoor unit 10 and the heat exchange device 100 may have a "three-pipe" connection structure, and the first fluid (i.e., refrigerant) may be circulated in the outdoor unit 10 and the heat exchange device 100 by the three connection pipes 20, 25 and 27.

The heat exchange device 100 and the indoor unit 60 may be fluidly connected by a second fluid. As an example, the second fluid may include water.

The water may flow through a water path of the heat exchangers 140-143 (FIG. 2) provided in the heat exchange device 100 and the indoor heat exchangers 61*a*-64*a* (FIG. 2) provided in the indoor unit 60. The plurality of heat exchangers 140, 141, 142 and 143 of the heat exchange device 100 may each include, for example, a plate type heat exchanger.

A number of indoor units 61, 62, 63 and 64 is not limited. In FIG. 1, for example, the four indoor units 61, 62, 63 and 64 are connected to the heat exchange device 100. The plurality of indoor units 61, 62, 63 and 64 may include a first indoor unit 61, a second indoor unit 62, a third indoor unit 63, and a fourth indoor unit 64.

The air conditioner 1 may further include indoor-unit connection pipes 30, 31, 32 and 33 connecting the heat exchange device 100 with the indoor unit 60. The second fluid (i.e., water) may be circulated in the heat exchange device 100 and the indoor unit 60 through the indoor-unit connection pipes 30, 31, 32 and 33.

The indoor-unit connection pipes 30, 31, 32 and 33 may include a first indoor-unit connection pipe 30 connecting the heat exchange device 100 to the first indoor unit 61, a second indoor-unit connection pipe 31 connecting the heat exchange device 100 to the second indoor unit 62, a third indoor-unit connection pipe 32 connecting the heat exchange device 100 to the third indoor unit 63, and a fourth indoor-unit connection pipe 33 connecting the heat exchange device 100 to the fourth indoor unit 61, 62, 63 and 64.

A number of indoor-unit connection pipes 30-34 may equal a number of indoor units 61-62. When the number of indoor units 61-64 increases, the number of indoor-unit connection pipes 30-33 connecting the heat exchange device 100 with the indoor units 61-64 may increase.

The refrigerant circulated in the outdoor unit 10 and the heat exchange device 100 and the water circulated in the heat exchange device 100 and the indoor unit 60 may exchange heat through the heat exchangers 140, 141, 142 and 143 (FIG. 2) provided in the heat exchange device 100. Water cooled or heated through heat exchange may exchange heat with the indoor heat exchangers 61*a*, 62*a*, 63*a* and 64*a* (FIG. 2) provided in the indoor unit 60, thereby performing cooling or heating of an indoor space.

The number of heat exchangers 140, 141, 142 and 143 (FIG. 2) in the heat exchange device 100 may be equal to the number of indoor units 61, 62, 63 and 64. Alternatively, two or more indoor units among the indoor units 60-64 may be connected to one heat exchanger (140, 141, 142, or 143 in FIG. 2).

Referring to FIGS. 1-2, the heat exchangers 140-143 of the heat exchange device 100 may include first, second, third, and fourth heat exchangers 140, 141, 142 and 143 fluidly connected to the first, second, third, and fourth indoor units 61, 62, 63 and 64, respectively.

The first, second, third, and fourth heat exchangers 140, 141, 142 and 143 may have a same or similar structure. The first, second, third, and fourth heat exchangers 140, 141, 142 and 143 may include, for example, plate type heat exchangers and may be configured to such that water paths and refrigerant paths are alternately stacked.

The first, second, third, and fourth heat exchangers 140, 141, 142 and 143 may include first, second, third, and fourth refrigerant paths 140*a*, 141*a*, 142*a* and 143*a* and first, second, third, and fourth water paths 140*b*, 141*b*, 142*b* and 143*b*.

The refrigerant paths 140*a*, 141*a*, 142*a* and 143*a* may be fluidly connected with the outdoor unit 10, and refrigerant discharged from the outdoor unit 10 may flow into the refrigerant paths 140*a*, 141*a*, 142*a* and 143, and/or the refrigerant which has passed through the refrigerant paths 140*a*, 141*a*, 142*a* and 143*a* may flow into the outdoor unit 10. The water paths 140*b*, 141*b*, 142*b* and 143*b* may be connected with the indoor units 61, 62, 63 and 64, the water discharged from the indoor units 61, 62, 63 and 64 may flow into the water paths 140*b*, 141*b*, 142*b* and 143*b*, and/or the water which has passed through the water paths 140*b*, 141*b*, 142*b* and 143*b* may flow into the indoor units 61, 62, 63 and 64.

The heat exchange device 100 may include a first connection pipe 131, a second connection pipe 132, a third connection pipe 133, a fourth connection pipe 134, a fifth connection pipe 135, a sixth connection pipe 136, a seventh connection pipe 137, and an eight connection pipe 138. The heat exchange device may also include a first valve device 120 having first, second and third ports 120*a*, 120*b*, and 120*c* and a second valve device 125 having first, second, and third ports 125*a*, 125*b*, and 25*c*. First, second, and third branch parts or joints 131*a*, 133*a*, and 134*a* and first and second bypass branch parts or joints 131*b* and 133*b* may be provided at joints or intersections of the connection pipes 131-137 and will be described in more detail later. The first, second, and third branch parts 131*a*, 133*a*, and 134*a* and the first and second bypass branch parts 131*b* and 133*b* may alternatively be referred to as first, second, and third branches and first and second bypass branches.

The first connection pipe 131 may be connected to the first outdoor-unit connection pipe 20 via a first service valve 21. The first connection pipe 131 may extend to an inside of the heat exchange device 100 and may be connected to a first port 120*a* of a first valve device or valve 120. As the first connection pipe 131 may be connected to the first outdoor-unit connection pipe 20, the first connection pipe 130 may be referred to as a high-pressure gas pipe.

The third connection pipe 133 may be connected to the second outdoor-unit connection pipe 25 via a second service valve 26. The third connection pipe 133 may extend to the inside of the heat exchange device 100 and may be connected to a third port 120*c* of the first valve device 120. As the third connection pipe 133 may be connected to the second outdoor-unit connection pipe 25, the third connection pipe 133 may also be referred to as a low-pressure gas pipe.

The fourth connection pipe 134 may be connected to the third outdoor-unit connection pipe 27 via a third service valve 28. The fourth connection pipe 134 may extend to the inside of the heat exchange device 100 and may be connected to the first heat exchanger 140 and the second heat exchanger 141.

The seventh connection pipe 137 may be connected to the third outdoor-unit connection pipe 27 via the third service valve 28. The seventh connection pipe 137 may extend to the inside of the heat exchange device 100 and may be connected to the first heat exchanger 140 and the second heat exchanger 141. As the fourth and seventh connection pipes 134 and 137 may be connected to the third outdoor-unit connection pipe 27, the fourth and seventh connection pipes 134 and 137 may also be referred to as liquid pipes.

The fourth connection pipe 134 and the seventh connection pipe 137 may be branched from a pipe extending from the third service valve 28 at the third branch part 134*a*. The seventh connection pipe 137 may extend from the third branch part 134*a* to be connected to the first heat exchanger 140 and the second heat exchanger 141.

The first to third outdoor-unit connection pipes 20, 25 and 27 may be connected to the heat exchange device 100 through the first to third service valves 21, 26 and 28, thereby achieving three-pipe connection between the outdoor unit 10 and the heat exchange device 100.

The first heat exchanger 140 may include the first refrigerant path 140*a* and the first water path 140*b*. One side or end of the first refrigerant path 140*a* may be connected to the second connection pipe 132. The second connection pipe 132 may extend from the second port 120*b* of the first valve device 120 to be connected to the first heat exchanger 140 and the second heat exchanger 141.

The other side or end of the first refrigerant path 140*a* may be connected to the fourth connection pipe 134. The fourth connection pipe 134 may extend from the third service valve 28 to be connected to the first heat exchanger 140 and the second heat exchanger 141.

The second heat exchanger 141 may include the second refrigerant path 141*a* and the second water path 141*b*. One side or end of the second refrigerant path 141*a* may be connected to the second connection pipe 132. The second connection pipe 132 may be branched and connected to the first heat exchanger 140 and the second heat exchanger 141.

The other side or end of the second refrigerant path 141*a* may be connected to the fourth connection pipe 134. The fourth connection pipe 134 may be branched and connected to the first heat exchanger 140 and the second heat exchanger 141.

The refrigerant discharged from the outdoor unit 10 may flow into the first refrigerant path 140*a* and the second refrigerant path 141*a* through the first connection pipe 131 and the first valve device 120. The refrigerant which has passed through the first refrigerant path 140*a* and the second refrigerant path 141*a* may flow into the outdoor unit 10 through the fourth connection pipe 134.

The third heat exchanger 142 may include the third refrigerant path 142*a* and the third water path 142*b*. One side or end of the third refrigerant path 142*a* may be connected to the sixth connection pipe 136. The sixth connection pipe 136 may extend from the second port 125*b* of the second valve device 125 to be connected to the third heat exchanger 142 and the fourth heat exchanger 143.

The other side or end of the third refrigerant path 142*a* may be connected to the seventh connection pipe 137. The seventh connection pipe 137 may extend from the third service valve 28 to be connected to the third heat exchanger 142 and the fourth heat exchanger 143.

The fourth heat exchanger 143 may include the fourth refrigerant path 143*a* and the fourth water path 143*b*. One side or end of the fourth refrigerant path 143*a* may be connected to the sixth connection pipe 136. The sixth connection pipe 136 may be branched and connected to the third heat exchanger 142 and the fourth heat exchanger 143.

The other side or end of the fourth refrigerant path 143*a* may be connected to the seventh connection pipe 137. The seventh connection pipe 137 may be branched and connected to the third heat exchanger 142 and the fourth heat exchanger 143.

The refrigerant discharged from the outdoor unit 10 may flow into the third refrigerant path 142*a* and the fourth refrigerant path 143*a* through the first connection pipe 131 and the second valve device 125. The refrigerant which has passed through the third refrigerant path 142*a* and the fourth refrigerant path 143*a* may flow into the outdoor unit 10 through the seventh connection pipe 137.

The first branch part 131*a* may be formed in the first connection pipe 131 to connect the first connection pipe and the fifth connection pipe 135. The fifth connection pipe 135 may extend to the second valve device 125. The fifth connection pipe 135 may be connected, at one side or end, to a first port 125*a* of the second valve device 125 and, at the other side or end, to the first branch part 131*a*.

The second branch part 133*a* may be formed in the third connection pipe 133 to connect the third connection pipe and the eighth connection pipe 138. The eighth connection pipe connected to the second branch part 133*a* may extend and be connected to the third port 125*b* of the second valve device 125.

The heat exchange device 100 includes the first valve device 120 and the second valve device 125 to control a flow direction of the refrigerant. The first valve device 120 and the second valve device 125 may include four-way valves or three-way valves. Hereinafter, an embodiment where the first valve device 120 and the second valve device 125 include four-wave valves will be described for convenience of description.

The first valve device 120 may include the first port 120*a* to which the first connection pipe 131 is connected, the second port 120*b* to which the second connection pipe 132 is connected, and the third port 120*c* to which and the third connection pipe 133 is connected. A fourth port of the first valve device 120 may be closed.

The second valve device 125 may include the first port 125*a* to which the fifth connection pipe 135 is connected, the second port 125*b* to which the sixth connection pipe 136 is connected, and the third port 125*c* to which the eighth connection pipe 138 is connected. A fourth port of the second valve device 125 may be closed.

The heat exchange device 100 may further include first and second expansion valves 144 and 145 to decompress and/or expand the refrigerant. The first and second expansion valves 144 and 145 may include electronic expansion valves (EEVs), but embodiments disclosed herein are not limited.

The first and second expansion valves 144 and 145 may decrease a pressure of the refrigerant passing through the expansion valves 144 and 145 by controlling an opening degree. For example, when the first and second expansion valves 144 and 145 are completely opened (i.e., a full-open state), the refrigerant may pass without being decompressed and, when the opening degree of the first and second expansion valves 144 and 145 decreases, the refrigerant may be decompressed. The degree of decompression of the refrigerant increases as the opening degree decreases.

The first expansion valve 144 may be installed or mounted in the fourth connection pipe 134 at a position between the third service valve 38 and the first refrigerant path 140*a* or the second refrigerant path 141*a*. The second expansion valve 145 may be installed or mounted in the seventh connection pipe 134 at a position between the third service valve 38 and the third refrigerant path 142*a* or the fourth refrigerant path 143*a*.

An operation in which operation modes of the plurality of indoor units 61, 62, 63 and 64 are the same may be referred to as a "dedicated operation." During the dedicated operation, all of the indoor heat exchangers 61*a*, 62*a*, 63*a* and 64*a* of the plurality of indoor units 61, 62, 63 and 64 may function as evaporators, or all of the indoor heat exchangers 61, 62*a*, 63*a*, and 64*a* may function as condensers. The plurality of indoor heat exchangers 61*a*, 62*a*, 63*a* and 64*a* may operate when the heat exchangers 61*a*, 62*a*, 63*a* and 64*a* are turned on rather than heat exchangers 61*a*, 62*a*, 63*a* and 64*a* are turned off.

An operation in which the operation modes of the plurality of indoor units 61, 62, 63 and 64 are different may be referred to as a "simultaneous operation." During the simultaneous operation, some of the plurality of indoor heat exchangers 61*a*, 62*a*, 63*a* and 64*a* may function as condensers, and other indoor heat exchangers may function as evaporators.

For example, during simultaneous operation of the air conditioner 1, a high-pressure gaseous refrigerant introduced through the first outdoor-unit connection pipe 20 and the first connection pipe 131 may flow into the first refrigerant path 140*a* of the first heat exchanger 140 and the second refrigerant path 141*a* of the second heat exchanger 141 (via the first valve device and the second connection pipe 132) to be condensed. Heating may be performed in the first indoor unit 61, the second indoor unit 62, and the third indoor unit 63, which are connected to the first heat exchanger 140 and the second heat exchanger 141.

The liquid refrigerant discharged from the first refrigerant path 140*a* and the second refrigerant path 141*a* may not be decompressed while passing through the first expansion valve 144. Some of the refrigerant which has passed through the first expansion valve 144 may be discharged to the third outdoor-unit connection pipe 27 through the third service valve 28. The remaining refrigerant may flow into the seventh connection pipe 137 at the third branch part 134*a* and may be decompressed to a low pressure while passing through the second expansion valve 145. The refrigerant may be introduced into the third refrigerant path 142*a* of the third heat exchanger 142 and the fourth refrigerant path 143*a* of the fourth heat exchanger 143 to be evaporated. Cooling may be performed in the fourth indoor unit 64, which is connected to the third heat exchanger 142 and the fourth heat exchanger 143. The low-pressure gaseous refrigerant discharged from the third refrigerant path 142*a* and the fourth refrigerant path 143*a* may be discharged to the second outdoor-unit connection pipe 25 through the sixth connection pipe 136, the second valve device 125, the eighth connection pipe 138, and the third connection pipe 133.

The heat exchange device 100 may further include a bypass pipe 210 connecting the first connection pipe 131 with the third connection pipe 133. The bypass pipe 210 may be a pipe to prevent liquid refrigerant from being accumulated in a high-pressure gas pipe (such as the first outdoor-unit connection pipe 20 or the first connection pipe 131) during a cooling operation. One end of the bypass pipe 210 may be connected to the first bypass branch part 131*b* of the first connection pipe 131, and the other end of the bypass pipe 210 may be connected to the second bypass branch part 133*b* of the third connection pipe 133.

The first branch part 131*a* may be formed in the first connection pipe 131 at a position between the first bypass branch part 131*b* and the first port 120*a* of the first valve device 120. The first bypass branch part 131*b* may be formed in the first connection pipe 131 at a position between the first service valve 21 and the first branch part 131*a*. The second branch part 133*a* may be formed in the third connection pipe 133 at a position between the second bypass branch part 133*b* and the third port 120*c* of the first valve device 120. The second bypass branch part 133*b* may be formed in the third connection pipe 133 at a position between the second service valve 26 and the second branch part 133*a*.

A bypass valve 212 to control an opening and/or closing of the bypass pipe 210 may be installed or mounted in the bypass pipe 210. As an example, the bypass valve 212 may include a two-way valve or a solenoid valve having relatively small pressure loss.

The bypass pipe 210 may be provided with a strainer or filter 211 to filter out waste from the refrigerant flowing through the bypass pipe 210. As an example, the strainer 212 may be formed of a metal mesh. The strainer 212 may be positioned at the bypass pipe 210 between the bypass valve 212 and the first bypass branch part 131*b*.

The bypass pipe 210 may include an expansion device or expander 213 to decompress or expand the refrigerant flowing through the bypass pipe 210. As an example, the expansion device 213 may include a capillary tube using a capillary phenomenon, but embodiments disclosed herein are not limited. The expansion device 213 may be positioned between the bypass valve 212 and the second bypass branch part 133*b*. The pressure of the refrigerant passing through the expansion device 213 may be lowered.

The heat exchange device 100 may further include heat exchanger inlet pipes 161*a*, 161*b*, 163*a* and 163*b* and heat exchanger discharge pipes 162*a*, 162*b*, 164*a* and 164*b* connected to the water paths 140*b*, 141*b*, 142*b* and 143*b* of the heat exchangers 140, 141, 142 and 143. The heat exchanger inlet pipes 161*a*, 161*b*, 163*a* and 163*b* may include first, second, third, and fourth heat exchanger inlet pipes 161*a*, 161*b*, 163*a* and 163*b*. The heat exchanger discharge pipes 162*a*, 162*b*, 164*a* and 164*b* may include first, second, third, and fourth heat exchanger discharge pipes 162*a*, 162*b*, 164*a* and 164*b*.

The first heat exchanger inlet pipe 161*a* may be connected to the first heat exchanger 140 and the second heat exchanger inlet pipe 161*b* may be connected to the second heat exchanger 141. The first and second heat exchanger inlet pipes 161*a* and 161*b* may be branched at a first common inlet pipe 161. The first common inlet pipe 161 may be provided with a first pump 151.

The third heat exchanger inlet pipe 163*a* may be connected to the third heat exchanger 142 and the fourth heat exchanger inlet pipe 163*b* may be connected to the fourth heat exchanger 143. The third and fourth heat exchanger inlet pipes 163*a* and 16*db* may be branched at a second common inlet pipe 163. The second common inlet pipe 163 may be provided with a second pump 152.

The first heat exchanger discharge pipe 162*a* may be connected to the first heat exchanger 140 and the second heat exchanger discharge pipe 162*b* may be connected to the second heat exchanger 141. The first and second heat exchanger discharge pipes 162*a* and 162*b* may be branched at a first common discharge pipe 162.

The third heat exchanger discharge pipe 164*a* may be connected to the third heat exchanger 142 and the fourth heat exchanger discharge pipe 164*b* may be connected to the fourth heat exchanger 143. The third and fourth heat exchanger discharge pipes 164*a* and 164*b* may be branched at a second common discharge pipe 164.

The first common inlet pipe 161 may be connected with a first coupling pipe 181. The second common inlet pipe 163 may be connected with a second coupling pipe 182. The first common discharge pipe 162 may be connected with a third coupling pipe 183. The second common discharge pipe 164 may be connected with a fourth coupling pipe 184.

The first coupling pipe 181 may be connected with a first water discharge pipe 171 through which water discharged from the indoor heat exchangers 61*a*, 62*a*, 63*a* and 64*a* flows. The second coupling pipe 182 may be connected with a second water discharge pipe 172 through which water discharged from the indoor heat exchangers 61*a*, 62*a*, 63*a* and 64*a* flows.

The first water discharge pipe 171 and the second water discharge pipe 172 may be provided in parallel and may be connected to common water discharge pipes 651, 652, 653 and 654 communicating with the indoor heat exchangers 61*a*, 62*a*, 63*a* and 64*a*. The common water discharge pipes 651, 652, 653, and 654 may include first, second, third, and fourth common water discharge pipes 651, 652, 653, and 654 connected to discharge pipes of the first, second, third, and fourth indoor heat exchangers 61*a*, 62*a*, 63*a* and 64*a*, respectively.

The first water discharge pipe 171, the second water discharge pipe 172, and the common water discharge pipes 651, 652, 653 and 654 may be connected by a three-way valve 173, for example. By the three-way valve 173, water from the common water discharge pipes 651, 652, 653 and 654 may flow into any one of the first water discharge pipe 171 and the second water discharge pipe 172.

The third coupling pipe 183 may be connected with first water inlet pipes 165*a*, 165*b*, 165*c* and 165*d*, through which water flows to be introduced into the indoor heat exchangers 61*a*, 62*a*, 63*a* and 64*a*. The fourth coupling pipe 184 may be connected with second water inlet pipes 1671, 167*b*, 167*c*, and 167*d* through which water flows to be introduced into the indoor heat exchangers 61*a*, 62*a*, 63*a* and 64*a*.

The first water inlet pipes 165*a*, 165*b*, 165*c* and 165*d* and the second water inlet pipes 1671, 167*b*, 167*c*, and 167*d* may be provided in parallel and may be connected with common inlet pipes 611, 621, 631 and 641 communicating with the indoor heat exchangers 61*a*, 62*a*, 63*a* and 64*a*.

The first water inlet pipes 165*a*, 165*b*, 165*c* and 165*d* may each be provided with a first valve 166, and the second water inlet pipes 167*a*, 167*b*, 167*c*, and 167*d* may each be provided with a second valve 167.

The first heat exchanger 140 and the second heat exchanger 141 may together be referred to as a "first heat exchange assembly" or a "first intermediate heat exchanger." The third heat exchanger 142 and the fourth heat exchanger 143 may together be referred to as a "second heat exchange assembly" or a "second intermediate heat exchanger."

Figure 3:
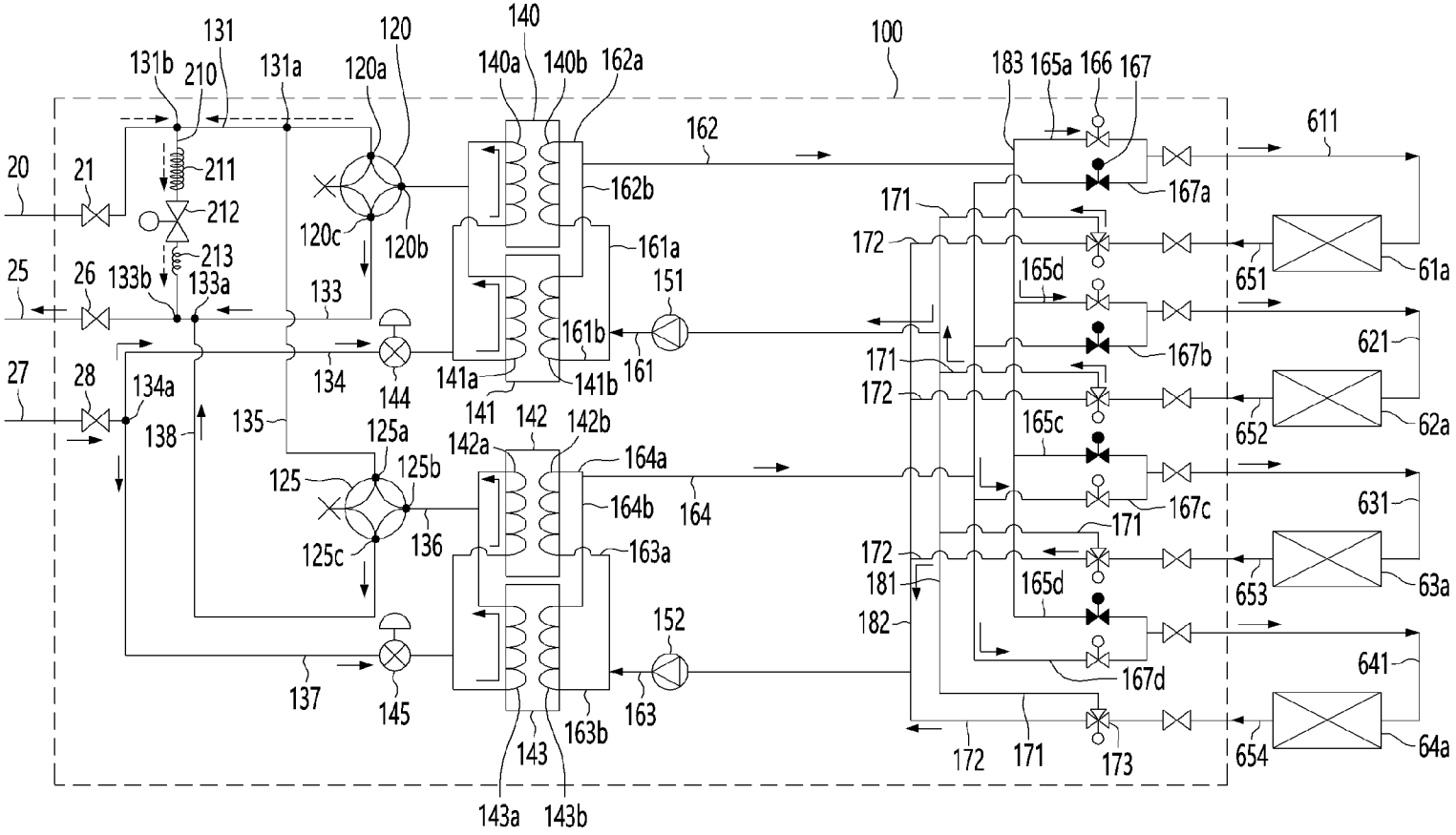
FIG. 3 is a cycle diagram showing a flow of refrigerant and water in a heat exchange device during a cooling operation of an air conditioner according to an embodiment.

Referring to FIGS. 1 and 3, when the air conditioner 1 performs a cooling operation such that the plurality of indoor units perform cooling, the high-pressure liquid refrigerant condensed in the outdoor heat exchanger 15 of the outdoor unit 10 may flow into the fourth connection pipe 134 through the third outdoor-unit connection pipe 27, and some refrigerant may be branched at the third branch part 134*a* to flow into the seventh connection pipe 137. An operation in which all the plurality of indoor units 61 through 64 perform cooling may be referred to as "cooling-dedicated operation".

The refrigerant of the fourth connection pipe 134 may be decompressed in the first expansion valve 144. The decompressed refrigerant may be introduced into the first refrigerant path 140*a* of the first heat exchanger 140 and the second refrigerant path 141*a* of the second heat exchanger 141 to exchange heat with the first water path 140*b* and the second water path 141*b*.

By heat exchange, the refrigerant of the first refrigerant path 140*a* and the second refrigerant path 141*a* may be evaporated, and the water of the first water path 140*b* and the second water path 141*b* may be cooled. The cooled water may flow into the first indoor heat exchanger 61*a* and the second indoor heat exchanger 62*a* to perform cooling.

The refrigerant of the seventh connection pipe 137 may be decompressed in the second expansion valve 145. The decompressed refrigerant may be introduced into the third refrigerant path 142*a* of the third heat exchanger 142 and the fourth refrigerant path 143*a* of the fourth heat exchanger 143 to exchange heat with the third water path 142*b* and the fourth water path 143*b*.

By heat exchange, the refrigerant of the third refrigerant path 142*a* and the fourth refrigerant path 143*a* may be evaporated, and the water of the third water path 142*b* and the fourth water path 143*b* may be cooled. The cooled water may flow into the third indoor heat exchanger 63*a* and the fourth indoor heat exchanger 64*a* to perform cooling.

During the cooling operation of the air conditioner 1, the heat exchangers 140, 141, 142 and 143 may function as "evaporators" for evaporating low-pressure 2-phase refrigerant. Since the heat exchangers 140, 141, 142 and 143 may be connected in parallel, a length of the evaporated refrigerant path may be relatively short, and a number of paths may increase. By maintaining evaporation pressure and/or preventing or reducing evaporation pressure from decreasing, a performance of the refrigerant cycle may be improved.

The refrigerant discharged from the first heat exchanger 140 and the second heat exchanger 141 may be introduced into the first valve device 120 through the second port 120*b* and discharged through the third port 120*c*. The refrigerant discharged from the first valve device 120 may flow into the third connection pipe 133 and flow into the outdoor unit 10 through the first outdoor-unit connection pipe 25.

The refrigerant discharged from the third heat exchanger 142 and the fourth heat exchanger 143 may be introduced into the second valve device 125 through the second port 125*b* and discharged through the third port 125*c*. The refrigerant discharged from the second valve device 125 may flow into the eighth connection pipe 138 and flow or join into the third connection pipe 133. The refrigerant flowing into the third connection pipe 133 may flow into the outdoor unit 10 through the first outdoor connection pipe 25. The refrigerant flowing into the outdoor unit 10 may be suctioned into the compressor 11.

When the air conditioner 1 performs the cooling operation, the bypass valve 212 mounted in the bypass pipe 210 may be opened. Refrigerant condensed in the outdoor unit 10 may flow into the third outdoor-unit connection pipe 27 (i.e., the liquid pipe) to be evaporated in the heat exchangers 140, 141, 142 and 143. The evaporated refrigerant may flow into the outdoor unit 10 through the second outdoor-unit connection pipe 25 (i.e., the low-pressure gas pipe).

The refrigerant of the first outdoor-unit connection pipe 20 and/or the first connection pipe 131 (i.e., the high-pressure gas pipes) may remain in the first outdoor-unit connection pipe 20 and/or the first connection pipe 131.

When such a state is maintained for a long time, liquid refrigerant may accumulate in the first outdoor-unit connection pipe 20 and/or the first connection pipe 131. When liquid refrigerant accumulates, an amount of refrigerant circulated in the system may decrease, worsening cycle stability.

However, when the bypass valve 212 is opened, liquid refrigerant accumulated in the first connection pipe 131, which may be a high-pressure gas pipe, may flow into the third connection pipe 133, which may be a low-pressure gas pipe, through the bypass pipe 210 due to a pressure difference. The wastes in the liquid refrigerant of the first connection pipe 131 may be filtered out by the strainer 211, and the liquid refrigerant may be decompressed through the expansion device 213. By opening the bypass valve 212, accumulation of refrigerant in the first connection pipe 131 (i.e., the high-pressure gas pipe) may be reduced or prevented, and refrigerant may be continued to be circulated in the refrigerant cycle.

Water flowing through the water paths 140*b*, 141*b*, 142*b* and 143*b* of the heat exchangers 140, 141, 142 and 143 may be cooled by heat exchange with the refrigerant. The cooled water may be supplied to the indoor heat exchangers 61*a*, 62*a*, 63*a* and 64*a* to perform cooling.

Water discharged into the first common discharge pipe 162 may flow into the first indoor heat exchanger 61*a* and the second indoor heat exchanger 62*a* through the first water inlet pipes 165*a* and 165*b*. Water discharged into the second common discharge pipe 164 may flow into the third indoor heat exchanger 63*a* and the fourth indoor heat exchanger 64*a* through the second water inlet pipes 167*c* and 167*d*.

The water flowing through the indoor heat exchangers 61*a*, 62*a*, 63*a* and 64*a* may exchange heat with inside air blown to the indoor heat exchangers 61*a*, 62*a*, 63*a*, and 64*a*. The water which has exchanged heat with the refrigerant in the heat exchangers 140, 141, 142 and 143 may be in a low-temperature state, and when inside air and water exchange heat while flowing through the indoor heat exchangers 61*a*, 62*a*, 63*a* and 64*a*, inside air may be cooled.

The water flowing through the first and second indoor heat exchangers 61*a* and 62*a* may flow into the first common inlet pipe 161 after flowing along the first water discharge pipe 171. The water flowing through the third and fourth indoor heat exchangers 63*a* and 64*a* may flow into the second common inlet pipe 163 after flowing along the second water discharge pipe 172.

Figure 4:
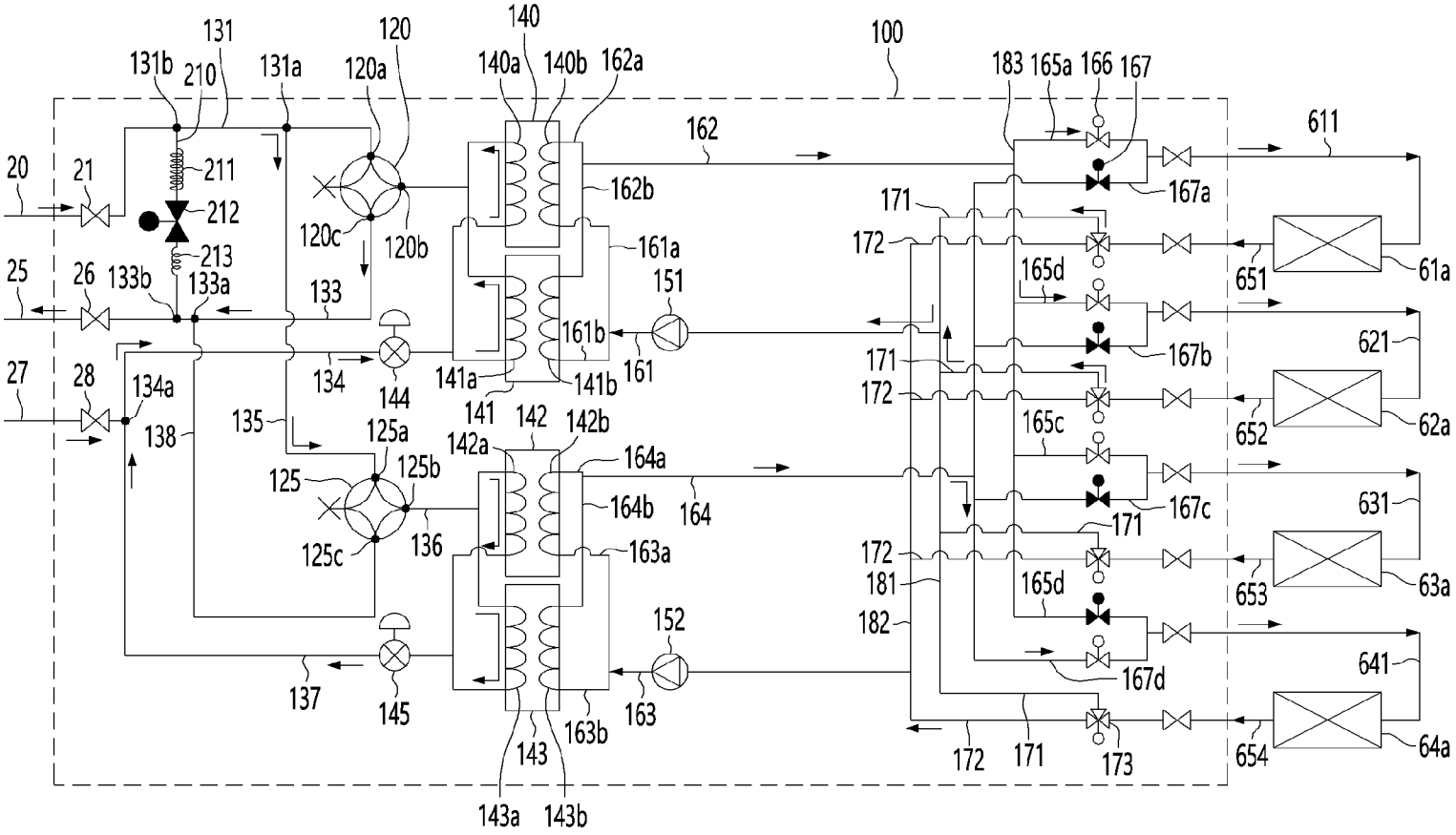
FIG. 4 is a cycle diagram showing a flow of refrigerant and water in a heat exchange device when some indoor units according to an embodiment perform cooling operation and other indoor units perform a heating operation.

Referring to FIGS. 1 and 4, some of the plurality of indoor units may perform cooling, while other indoor units may perform heating. In such a simultaneous operation in which the operation modes of the plurality of indoor units are different, some of the plurality of heat exchangers may function as evaporators while other heat exchangers may function as condensers.

For convenience of description, a case where first to third indoor units 61, 62 and 63 perform cooling and the fourth indoor unit 64 performs heating will be described as an example. Such a configuration may be referred to as a "main cooling operation." For the first to third indoor units 61, 62 and 63 to perform cooling and for the fourth indoor unit 64 to perform heating, the first and second heat exchangers 140 and 141 may function as evaporators and the third and fourth heat exchangers 142 and 143 may function as condensers.

A high-pressure liquid refrigerant may be condensed in the outdoor heat exchanger 15 of the outdoor unit 10 and flow into the fourth connection pipe 134 through the third outdoor-unit connection pipe 27. The refrigerant of the fourth connection pipe 134 may be decompressed in the first expansion valve 144. The decompressed refrigerant may be introduced into the first refrigerant path 140*a* of the first heat exchanger 140 and the second refrigerant path 141*a* of the second heat exchanger 141 to exchange heat with the first water path 140*b* and the second water path 141*b*.

By heat exchange, the refrigerant of the first refrigerant path 140*a* and the second refrigerant path 141*a* may be evaporated, and the water of the first water path 140*b* and the second water path 141*b* may be cooled. The cooled water may flow into the first indoor heat exchanger 61*a* and the second indoor heat exchanger 62*a* to perform cooling. The first heat exchanger 140 and the second heat exchanger 141 may function as "evaporators" to evaporate low-pressure 2-phase refrigerant.

The refrigerant discharged from the first heat exchanger 140 and the second heat exchanger 141 may be introduced into the first valve device 120 through the second port 120*b* and discharged through the third port 120*c*. The refrigerant discharged from the first valve device 120 may flow into the third connection pipe 133 and flow into the outdoor unit 10 through the first outdoor-unit connection pipe 25.

A high-pressure gaseous refrigerant compressed in the compressor 11 of the outdoor unit 10 may flow into the first connection pipe 131 through the first outdoor-unit connection pipe 20. The first outdoor-unit connection pipe 20 may be coupled to an outlet or a port of the compressor. The refrigerant of the first connection pipe 131 may be branched into the fifth connection pipe 135 at the first branch part 131*a* and introduced into the second valve device 125 through the first port 125*a*. The refrigerant discharged from the second port 125*b* of the second valve device 125 may flow through the sixth connection pipe 136 and flow into the third refrigerant path 142*a* of the third heat exchanger 142 and the fourth refrigerant path 143*a* of the fourth heat exchanger 143 to exchange heat with the third water path 142*b* and the fourth water path 143*b*.

By heat exchange, the refrigerant of the third refrigerant path 142*a* and the fourth refrigerant path 143*a* may be condensed, and the water of the third water path 142*b* and the fourth water path 143*b* may be heated. The heated water may flow into the third indoor heat exchanger 63*a* and the fourth indoor heat exchanger 64*a* to perform heating. The third heat exchanger 142 and the fourth heat exchanger 143 may function as "condensers" to condense high-pressure gaseous refrigerant.

The refrigerant discharged from the third heat exchanger 142 and the fourth heat exchanger 143 may be combined with the liquid refrigerant flowing through the third outdoor-unit connection pipe 27 after passing through the second expansion valve 145. The refrigerant discharged from the third heat exchanger 142 and the fourth heat exchanger 143 may pass through the second expansion valve 145 without decompression.

The water flowing through the water paths 140*b* and 141*b* of the first and second heat exchangers 140 and 141 may be cooled by heat exchange with the refrigerant. The cooled water may be supplied to the first to third indoor heat exchangers 61*a*, 62*a* and 63*a* to perform cooling.

The water flowing through the water paths 142*b* and 143*b* of the third and fourth heat exchangers 142 and 143 may be heated by heat exchange with the refrigerant. The heated water may be supplied to the fourth indoor heat exchanger 64*a* to perform heating.

The water discharged into the first common discharge pipe 162 may flow into the first through third indoor heat exchangers 61*a*, 62*a* and 63*a* through the first water inlet pipes 165*a*, 165*b* and 165*c*. The water discharged to the second common discharge pipe 164 may flow into the fourth indoor heat exchanger 64*a* through the second water inlet pipe 167*d*.

The water flowing through the indoor heat exchangers 61*a*, 62*a*, 63*a* and 64*a* may exchange heat with inside air blown to the indoor heat exchangers. The water that has exchanged heat with the refrigerant in the first and second heat exchangers 140 and 141 may be in a low-temperature state, and when inside air and water exchange heat while flowing through the first through third indoor heat exchangers 61*a*, 62*a* and 63*a*, inside air may be cooled. The water that has exchanged heat with the refrigerant in the third and fourth heat exchangers 142 and 143 may be in a high-temperature state, and when inside air and water exchange heat while flowing through the fourth indoor heat exchanger 64*a*, indoor heat may be heated.

The water flowing through the first through third indoor heat exchangers 61*a*, 62*a* and 63*a* may flow into the first common inlet pipe 161 after flowing along the first water discharge pipe 171. The water flowing through the fourth indoor heat exchanger 64*a* may flow into the second common inlet pipe 163 after flowing along the second water discharge pipe 172.

Figure 5:
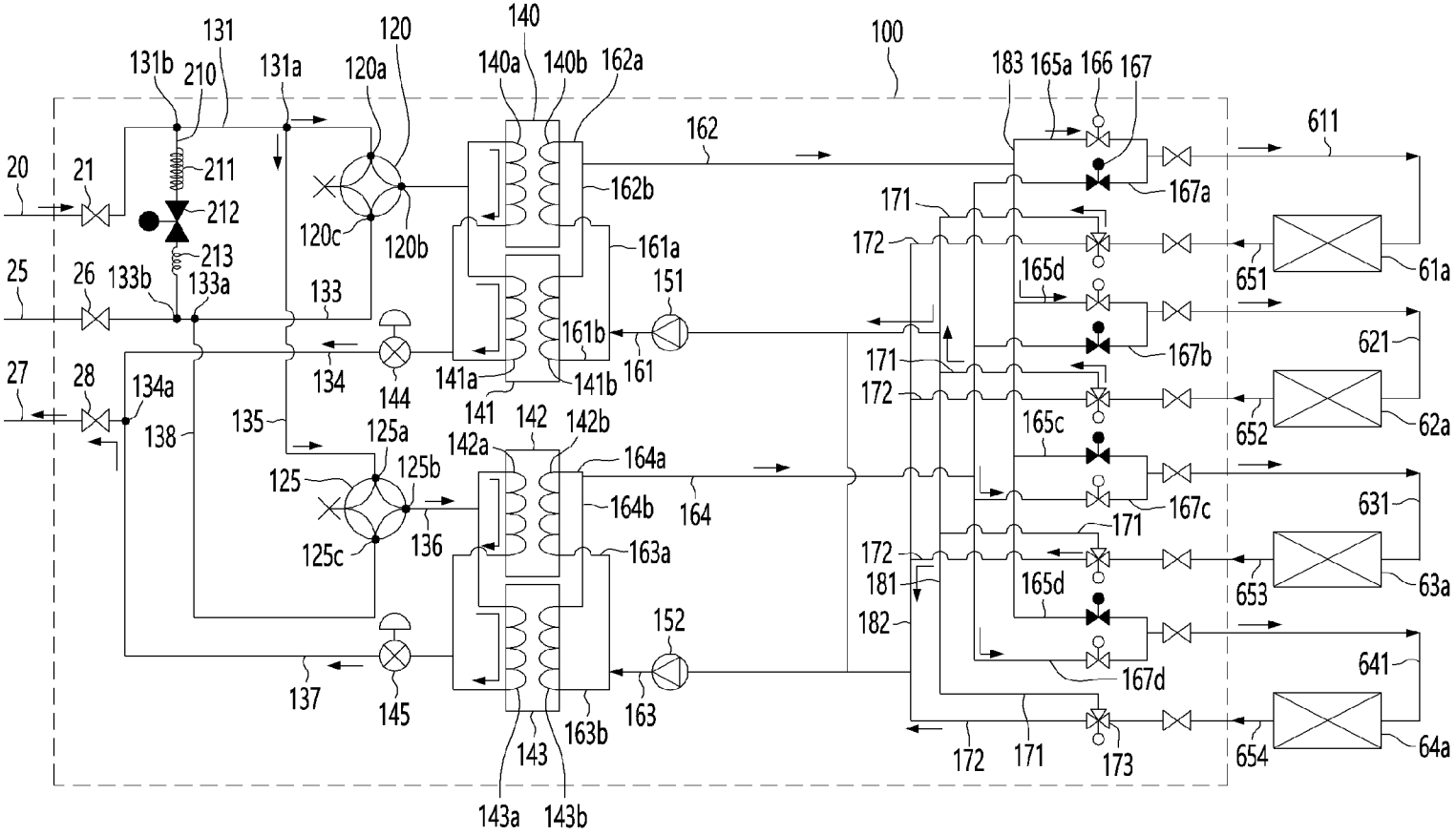
FIG. 5 is a cycle diagram showing a flow of refrigerant and water in a heat exchange device during a heating operation of an air conditioner according to an embodiment.

Referring to FIGS. 1 and 5, when the air conditioner 1 performs a dedicated heating operation such that all of the plurality of indoor units perform heating, a high-pressure gaseous refrigerant compressed in the compressor 10 of the outdoor unit 10 may flow into the first connection pipe 131 through the first outdoor-unit connection pipe 20. Some refrigerant may be branched at the first branch part 134*a* and introduced into the fifth connection pipe 135.

The refrigerant of the first connection pipe 131 may flow into the first valve device 120 through the first port 120*a*, and the refrigerant of the fifth connection pipe 135 may flow into the second valve device 125 through the first port 125*a*. The refrigerant flowing into the first valve device 120 may be discharged through the second port 120*b*. The discharged refrigerant may be introduced into the first refrigerant path 140*a* of the first heat exchanger 140 and the second refrigerant path 141*a* of the second heat exchanger 141 to exchange heat with the first water path 140*b* and the second water path 141*b*.

The refrigerant flowing into the second valve device 125 may be discharged through the second port 125*b*. The discharged refrigerant may be introduced into the third refrigerant path 142*a* of the third heat exchanger 142 and the fourth refrigerant path of the fourth heat exchanger 143 to exchange heat with the third water path 142*b* and the fourth water path 143*b*.

By heat exchange, the refrigerant of the first through fourth refrigerant paths 140*a*, 141*a*, 142*a* and 143*a* may be condensed, and the water of the first through fourth water paths 140*b*, 141*b*, 142*b* and 143*b* may be heated. The heated water may flow into the first through fourth indoor heat exchangers 61*a*, 62*a*, 63*a* and 64*a* to perform heating. During the dedicated heating operation of the air conditioner 1, the heat exchangers 140, 141, 142 and 143 may function as "condensers" to compress high-pressure gaseous refrigerant.

The refrigerant discharged from the first heat exchanger 140 and the second heat exchanger 141 may be decompressed in the first expansion valve 144 and introduced into the fourth connection pipe 134. The refrigerant of the fourth connection pipe 134 may flow into the outdoor unit 10 through the third outdoor-unit connection pipe 27.

The refrigerant discharged from the third heat exchanger 142 and the fourth heat exchanger 143 may be decompressed in the second expansion valve 145 and introduced into the seventh connection pipe 137. The refrigerant of the seventh connection pipe 137 may flow into the outdoor unit 10 through the third outdoor-unit connection pipe 27. The refrigerant flowing into the outdoor unit 10 may be evaporated in the outdoor heat exchanger 15 and suctioned into the compressor 11.

The water flowing through the water paths 140*b*, 141*b*, 142*b* and 143*b* of the heat exchangers 140, 141, 142 and 143 may be heated by heat exchange with the refrigerant, and the heated water may be supplied to the indoor heat exchangers 61*a*, 62*a*, 63*a* and 64*a* to perform heating.

The water discharged to the first common discharge pipe 162 may flow into the first indoor heat exchanger 61*a* and the second indoor heat exchanger 62*a* through the first water inlet pipes 165*a* and 165*b*. The water discharged to the second common discharge pipe 164 may flow into the third indoor heat exchanger 63*a* and the fourth indoor heat exchanger 64*a* through the second water inlet pipes 167*c* and 167*d*.

The water flowing through the indoor heat exchangers 61*a*, 62*a*, 63*a* and 64*a* may exchange heat with the inside air blown to the indoor heat exchangers 61-64. The water that has exchanged heat with the refrigerant in the heat exchangers 140, 141, 142 and 143 may be in a high-temperature state, and when inside air and water exchange heat while flowing through the indoor heat exchangers 61*a*, 62*a*, 63*a* and 64*a*, inside air may be heated.

The water flowing through the first and second indoor heat exchangers 61*a* and 62*a* may flow into the first common inlet pipe 161 after flowing along the first water discharge pipe 171. The water flowing through the third and fourth indoor heat exchangers 63*a* and 64*a* may flow into the second common inlet pipe 163 after flowing along the second water discharge pipe 172.

Figure 6:
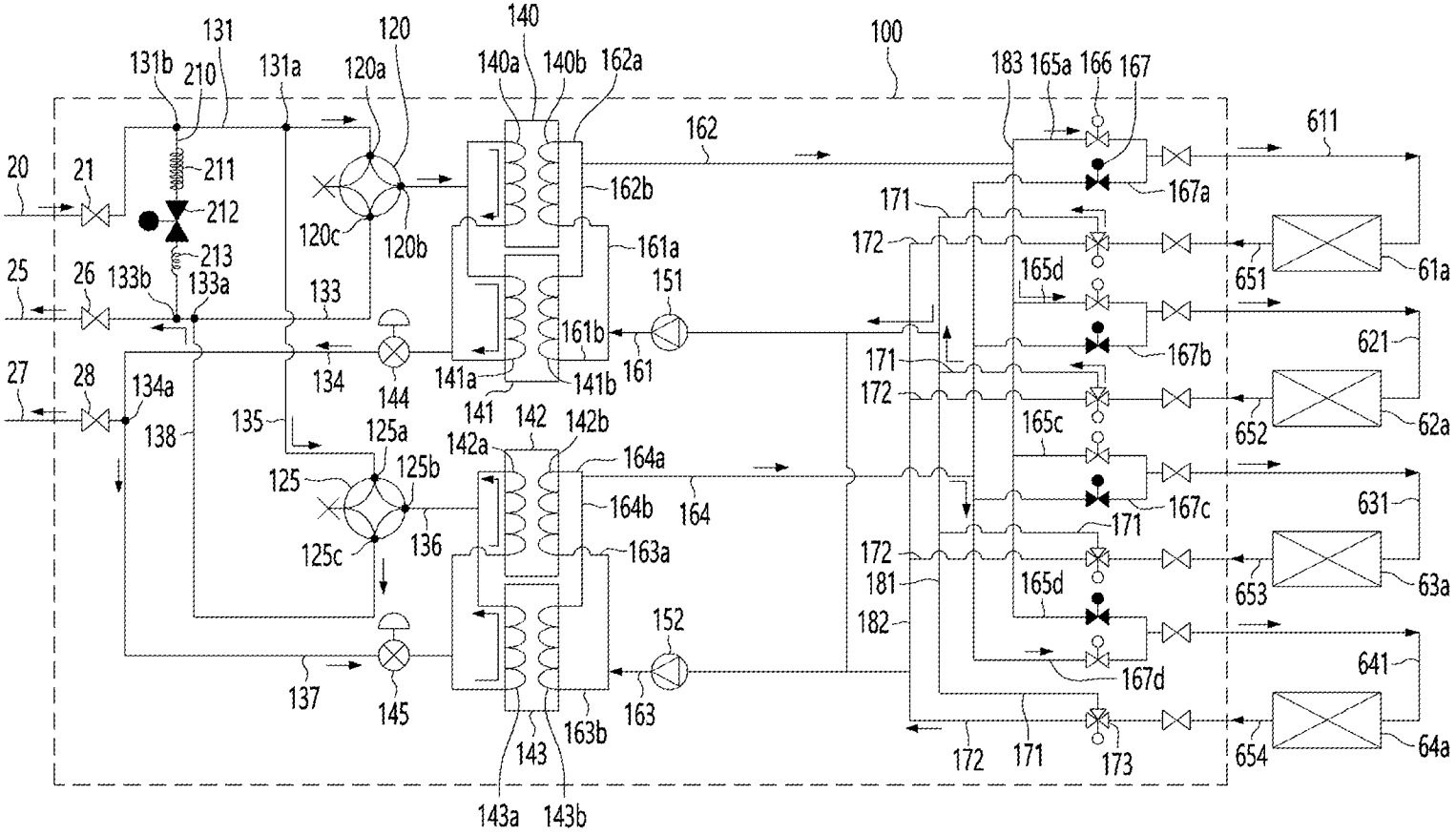
FIG. 6 is a cycle diagram showing a flow of refrigerant and water in a heat exchange device when some indoor units perform a heating operation and other indoor units perform a cooling operation.

Referring to FIG. 6, some of the plurality of indoor units 61 through 64 may perform heating while others may perform cooling. In such a simultaneous operation, some of the plurality of indoor heat exchangers 61*a*-64*a* may function as condensers, while others of the plurality of indoor heat exchangers 61*a*-64*a* may function as evaporators.

For convenience of description, a case where the first through third indoor units 61, 62 and 63 perform heating and the fourth indoor unit 64 performs cooling will be described. Such a configuration may be referred to as a "main heating operation."

For the first through third indoor units 61, 62 and 63 to perform heating and for the fourth indoor unit 64 to perform cooling, the first and second heat exchangers 140 and 141 may function as condensers, and the third and fourth heat exchangers 142 and 143 may function as evaporators. When the air conditioner 1 performs the "main heating" simultaneous operation, a high-pressure gaseous refrigerant may be compressed in the compressor of the outdoor unit 10 and flow into the first connection pipe 131 through the first outdoor-unit connection pipe 20.

The refrigerant of the first connection pipe 131 may flow into the first valve device 120 through the first port 120*a*. The refrigerant flowing into the first valve device 120 may be discharged through the second port 120*b*. The discharged refrigerant may be introduced into the first refrigerant path 140*a* of the first heat exchanger 140 and the second refrigerant path 141*a* of the second heat exchanger 141 to exchange heat with the first water path 140*b* and the second water path 141*b*.

By heat exchange, the refrigerant of the first and second refrigerant paths 140*a* and 141*a* may be condensed, and the water of the first and second water paths 140*b* and 141*b* may be heated. The heated water may flow into the first through third indoor heat exchangers 61*a*, 62*a* and 63*a* to perform heating. The first through third heat exchangers 140, 141 and 142 may function as "condensers" for compressing the high-pressure gaseous refrigerant.

The refrigerant discharged from the first heat exchanger 140 and the second heat exchanger 141 may pass through the first expansion valve 144 and flow into the fourth connection pipe 134. The refrigerant of the fourth connection pipe 134 may flow into the outdoor unit 10 through the third outdoor-unit connection pipe 27. The refrigerant flowing into the outdoor unit 10 may be evaporated in the outdoor heat exchanger 15 and then suctioned into the compressor 11.

Some of the refrigerant passing through the fourth connection pipe 134 may flow into the seventh connection pipe 137. The refrigerant of the seventh connection pipe 137 may be decompressed in the second expansion valve 145 and introduced into the third refrigerant path 142*a* of the third heat exchanger 142 and the fourth refrigerant path 143*a* of the fourth heat exchanger 143 to exchange heat with the third water path 142*b* and the fourth water path 143*b*.

By heat exchange, the refrigerant of the third and fourth refrigerant paths 142*a* and 143*a* may be evaporated, and the water of the third and fourth water paths 142*b* and 143*b* may be cooled. The cooled water may flow into the fourth indoor heat exchanger 64*a* to perform cooling. The fourth heat exchanger 143 may function as an "evaporator" to evaporate low-pressure 2-phase refrigerant.

The refrigerant discharged from the third heat exchanger 142 and the fourth heat exchanger 143 may flow into the second valve device 125 through the second port 125*b*. The refrigerant discharged through the third port 125*c* of the second valve device 125 may flow into the eighth connection pipe 138. The refrigerant of the eighth connection pipe 138 may flow into the outdoor unit 10 through the second outdoor-unit connection pipe 25. The refrigerant flowing into the outdoor unit 10 may be suctioned into the compressor 11.

The water flowing through the water paths 140*b* and 141*b* of the first and second heat exchangers 140 and 141 may be heated by heat exchange with the refrigerant, and the heated water may be supplied to the first through third indoor heat exchangers 61*a*, 62*a* and 63*a* to perform heating. The water flowing through the water paths 142*b* and 143*b* of the third and fourth heat exchangers 142 and 143 may be cooled by heat exchange with the refrigerant, and the cooled water may be supplied to the fourth indoor heat exchanger 64*a* to perform cooling.

The water discharged to the first common discharge pipe 162 may flow into the first through third indoor heat exchangers 61*a*, 62*a* and 63*a* through the first water inlet pipes 165*a*, 165*b* and 165*c*. The water discharged into the second common discharge pipe 164 may flow into the fourth indoor heat exchanger 64*a* through the second water inlet pipe 167*d*.

The water flowing through the indoor heat exchangers 61*a*, 62*a*, 63*a* and 64*a* may exchange heat with inside air blown to the indoor heat exchangers 61*a*, 62*a*, 63*a*, and 64*a*. The water that has exchanged heat with the refrigerant in the first and second heat exchangers 140 and 141 may be in a high-temperature state, and when inside air and water exchange heat while flowing through the first through third indoor heat exchangers 61*a*, 62*a* and 63*a*, inside air may be heated. The water that has exchanged heat with the refrigerant in the third and fourth heat exchangers 142 and 143 may be in a low-temperature state, and when inside air and water exchange heat while flowing through the fourth indoor heat exchanger 64*a*, inside air may be cooled.

The water flowing through the first through third indoor heat exchangers 61*a*, 62*a* and 63*a* may flow into the first common inlet pipe 161 after flowing along the first water discharge pipe 171. The water flowing through the fourth indoor heat exchanger 64*a* may flow into the second common inlet pipe 163 after flowing along the second water discharge pipe 172.

An air conditioning apparatus or an air conditioner according to an embodiment may have the above-described configuration and have the following effects. During a cooling operation of the indoor unit, embodiments disclosed herein may prevent or reduce liquid refrigerant from being accumulated in a high-pressure gas pipe and a refrigerant shortage in a refrigeration cycle. By opening a bypass valve mounted in a bypass pipe connecting the high-pressure gas pipe with a low-pressure gas pipe, bypassing of the liquid refrigerant accumulated in the high-pressure gas pipe to the low-pressure gas pipe may be possible. A sufficient amount of refrigerant circulated in the cycle may be maintained, thereby improving an air conditioning performance. By providing a strainer or strainer in the bypass pipe at a side corresponding to the inlet side of the bypass valve, embodiments disclosed herein may filter out waste in refrigerant flowing through the pipe bypass pipe.

During the cooling operation, when the plurality of heat exchangers provided in the heat exchange apparatus function as evaporators, the refrigerant may be branched and introduced into the plurality of heat exchangers. A number of refrigerant paths may be increased, and a length of the refrigerant paths may be decreased by parallel connection of the heat exchangers, thereby preventing or reducing an occurrence of evaporation pressure from being lowered.

During a heating operation, when the plurality of heat exchangers function as condensers, the refrigerant may sequentially pass through the plurality of heat exchangers. A length of the refrigerant paths may be increased and a number of refrigerant paths may be decreased based on a series connection of the heat exchangers, thereby improving condensing performance of the heat exchangers.

Since an outdoor unit and the heat exchange apparatus may be connected through three pipes, a cooling operation and a heating operation may be simultaneously performed, and some indoor units may perform a heating operation and the other indoor units may perform a cooling operation. Since use of the three-way valve used in the water pipe may be minimized, embodiments disclosed herein may prevent or reduce a phenomenon wherein a flow rate is insufficient due to pressure loss, and may simplify valve control.

Embodiments disclosed herein may prevent or reduce liquid refrigerant from being accumulated in a high-pressure gas pipe during a cooling operation of an indoor unit. Embodiments disclosed herein may prevent or reduce evaporation pressure from being lowered when a plurality of heat exchangers provided in a heat exchange device functions as evaporators during a cooling operation. Embodiments disclosed herein may improve condensing performance when a plurality of heat exchangers functions as condensers during heating operation.

Embodiments disclosed herein may be capable of simultaneously performing cooling operation and heating operation by connecting an outdoor unit with a heat exchange device through three pipes. Embodiments disclosed herein may prevent or reduce a phenomenon wherein a flow rate is insufficient due to pressure loss and simplify valve control by minimizing use of a three-way valve used in a water pipe.

Embodiments disclosed herein may be implemented as an air conditioner including a bypass pipe and a bypass valve mounted or installed in the bypass pipe. The bypass pipe may connect a first bypass branch part of a first connection pipe, through which high-pressure refrigerant flows, with a second bypass branch part of a third connection pipe, through which low-pressure refrigerant flows, to allow bypassing of high-pressure refrigerant in the first connection pipe to the third connection pipe.

During a cooling operation of an indoor unit, the bypass valve may be opened to allow bypassing of high-pressure refrigerant of the first connection pipe to the third connection pipe, which may prevent or reduce liquid refrigerant from accumulating in a high-pressure gas pipe and prevent or reduce a refrigerant shortage in a refrigeration cycle.

The air conditioner may include an outdoor unit including a compressor and an outdoor heat exchanger and configured to circulate refrigerant, an indoor unit configured to circulate water, first and second heat exchangers configured to perform heat exchange between the refrigerant and the water, a first valve device connected to the first heat exchanger and configured to control a flow direction of the refrigerant, and a second valve device connected to the second heat exchanger and configured to control a flow direction of the refrigerant.

The air conditioner may include a first connection pipe connected to a first port of the first valve device such that high-pressure refrigerant compressed in the compressor flows therethrough, and forming a first bypass branch part, a second connection pipe connected to a second port of the first valve device and connected to the first heat exchanger, and a third connection pipe connected to a third port of the first valve device such that evaporated low-pressure refrigerant flows therethrough, and forming a second bypass branch part.

During a heating operation of the indoor unit, the bypass valve may be closed to limit bypassing of the refrigerant of the first connection pipe to the third connection pipe. A plurality of indoor units may be provided, and, when the outdoor unit operates for a cooling operation of the indoor units, some of the plurality of indoor units perform a cooling operation, and the other indoor units perform a heating operation, the bypass valve may be closed to limit or block bypassing of the refrigerant of the first connection pipe to the third connection pipe.

A plurality of indoor units may be provided, and, when the outdoor unit operates for heating operation of the indoor units, some of the plurality of indoor units perform a heating operation, and the other indoor units perform a cooling operation, the bypass valve may be closed to limit bypassing of the refrigerant of the first connection pipe to the third connection pipe.

The air conditioner may further include a strainer or filter provided in the bypass pipe and located at a point between the first bypass branch part and the bypass valve to filter out wastes in the refrigerant. The air conditioner may further include an expansion device provided in the bypass pipe and located at a point between the second bypass branch part and the bypass valve to decompress the refrigerant.

The air conditioner may further include a fourth connection pipe connected to the first heat exchanger and provided with a first expansion valve, and, during a cooling operation of the indoor unit, refrigerant condensed in the outdoor unit may be evaporated in the first heat exchanger through the fourth connection pipe. The air conditioner may further include a first branch part formed in the first connection pipe, and a fifth connection pipe connected to the first branch part and connected to the first port of the second valve device. The first branch part may be formed at a point between the first bypass branch part and the first port of the first valve device.

The air conditioner may further include a second branch part formed in the third connection pipe, and an eighth connection pipe connected to the second branch part and connected to the third port of the second valve device. The second branch part may be formed at a point between the second bypass branch part and the third port of the first valve device.

The air conditioner may further include a sixth connection pipe connected to the second port of the second valve device and connected to the second heat exchanger, and a seventh connection pipe connected to the second heat exchanger and coupled to a third branch part of the fourth connection pipe. The seventh connection pipe may be provided with a second expansion valve.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

an outdoor unit including a compressor and an outdoor heat exchanger, the outdoor unit being configured to circulate a first fluid;

at least one indoor unit configured to circulate a second fluid;

a first intermediate heat exchanger configured to perform heat exchange between the first and second fluids;

a first valve connected to the first intermediate heat exchanger and configured to control a flow direction of the first fluid, the first valve having a first port, a second port, and a third port;

a first connection pipe connected to the first port of the first valve and in fluid communication with the outdoor unit such that the first fluid, after being compressed in the compressor, flows therethrough;

a second connection pipe connected to the first intermediate heat exchanger and the second port of the first valve;

a third connection pipe connected to the third port of the first valve and in fluid communication with the outdoor unit such that the first fluid, after being evaporated, flows therethrough;

a bypass pipe connecting the first connection pipe to the third connection pipe;

a bypass valve provided in the bypass pipe to open or close the bypass pipe, wherein, during a cooling operation of the indoor unit, the bypass valve is opened to allow a flow of the first fluid in the first connection pipe to the third connection pipe; and a strainer provided in the bypass pipe to filter out foreign matter from the first fluid, wherein the strainer is provided at a position between the bypass valve and where the bypass pipe connects to the first connection pipe.

2. The air conditioner of claim 1, wherein the first fluid is refrigerant, and the second fluid is water.

3. The air conditioner of claim 1, wherein, during a heating operation of the indoor unit, the bypass valve is closed to block a flow of the first refrigerant in the first connection pipe to the third connection pipe.

4. The air conditioner of claim 1, wherein the at least one indoor unit includes a plurality of indoor units, and, during a simultaneous operation of the indoor units where some of the plurality of indoor units perform a cooling operation and others of the plurality of indoor units perform a heating operation, the bypass valve is closed.

5. The air conditioner of claim 1, further comprising an expansion device provided in the bypass pipe to decompress the first fluid, wherein the expansion device is provided at a position between the bypass valve and where the bypass pipe connects to the third connection pipe.

6. The air conditioner of claim 1, further comprising:

a fourth connection pipe connected to the first intermediate heat exchanger and in fluid communication with the outdoor unit; and an expansion valve provided in the fourth connection pipe, wherein, during a cooling operation of the indoor unit, the first fluid is condensed in the outdoor unit and evaporated in the first intermediate heat exchanger through the fourth connection pipe.

7. The air conditioner of claim 1, wherein the indoor unit is provided in an indoor space, and the indoor unit includes an indoor heat exchanger to allow the second fluid to exchange heat with air of the indoor space.

8. The air conditioner of claim 1, further comprising first and second outdoor-unit connection pipes connected to the outdoor unit, wherein the first outdoor-unit connection pipe is connected to the first connection pipe, and the second outdoor-unit connection pipe is connected to the third connection pipe.

9. The air conditioner of claim 8, further comprising a first service valve and a second service valve, wherein the first service valve is provided between the first outdoor-unit connection pipe and the first connection pipe, and the second service valve is provided between the second outdoor-unit connection pipe and the third connection pipe.

10. The air conditioner of claim 1, further comprising:

a second intermediate heat exchanger configured to perform heat exchange between the first and second fluids; and a second valve connected to the second intermediate heat exchanger and configured to control a flow direction of the first fluid.

11. The air conditioner of claim 10, further comprising:

a fourth connection pipe connected to the first intermediate heat exchanger and in fluid communication with the outdoor unit;

a first expansion valve provided in the fourth connection pipe; and a fifth connection pipe connected to the first connection pipe and a first port of the second valve.

12. The air conditioner of claim 11, wherein the fifth connection pipe connects to the first connection pipe at a position between where the first connection pipe connects to the first port of the first valve and where the first connection pipe connects to the bypass pipe.

13. The air conditioner of claim 11, further comprising a sixth connection pipe connected to the second intermediate heat exchanger and to a second port of the second valve.

14. The air conditioner of claim 13, further comprising:

a seventh connection pipe connected to the second intermediate heat exchanger and to the fourth connection pipe; and a second expansion valve provided in the seventh connection pipe.

15. The air conditioner of claim 14, wherein:

the first intermediate heat exchanger includes a first heat exchanger connected to the second connection pipe and a second heat exchanger connected to the fourth connection pipe; and the second intermediate heat exchanger includes a third heat exchanger connected to the sixth connection pipe and a fourth heat exchanger connected to the seventh connection pipe.

16. The air conditioner of claim 14, further comprising an eighth connection pipe connected to the third connection pipe and a third port of the second valve.

17. The air conditioner of claim 16, wherein the eighth connection pipe is connected to the third connection pipe at a position between where the third connection pipe connects to the bypass pipe and where the third connection pipe connects to the third port of the first valve device.

18. An air conditioner, comprising:

an outdoor unit including a compressor and an outdoor heat exchanger, the outdoor unit being configured to circulate a first fluid;

at least one indoor unit configured to circulate a second fluid;

a first intermediate heat exchanger configured to perform heat exchange between the first and second fluids;

a first valve connected to the first intermediate heat exchanger and configured to control a flow direction of the first fluid, the first valve having a first port, a second port, and a third port;

a first connection pipe connected to the first port of the first valve and in fluid communication with the outdoor unit such that the first fluid, after being compressed in the compressor, flows therethrough;

a second connection pipe connected to the first intermediate heat exchanger and the second port of the first valve;

a third connection pipe connected to the third port of the first valve and in fluid communication with the outdoor unit such that the first fluid, after being evaporated, flows therethrough;

a bypass pipe connecting the first connection pipe to the third connection pipe; and a bypass valve provided in the bypass pipe to open or close the bypass pipe, wherein, during a cooling operation of the indoor unit, the bypass valve is opened to allow a flow of the first fluid in the first connection pipe to the third connection pipe, wherein a capillary tube is provided in the bypass pipe to expand the first fluid, and wherein the capillary tube is provided at a position between the bypass valve and where the bypass pipe connects to the third connection pipe.

19. An air conditioner, comprising:

an outdoor unit including a compressor and an outdoor heat exchanger, the outdoor unit being configured to circulate a first fluid;

at least one indoor unit configured to circulate a second fluid;

a first intermediate heat exchanger configured to perform heat exchange between the first and second fluids;

a first valve connected to the first intermediate heat exchanger and configured to control a flow direction of the first fluid, the first valve having a first port, a second port, and a third port;

a first connection pipe connected to the first port of the first valve and in fluid communication with the outdoor unit such that the first fluid, after being compressed in the compressor, flows therethrough;

a second connection pipe connected to the first intermediate heat exchanger and the second port of the first valve;

a third connection pipe connected to the third port of the first valve and in fluid communication with the outdoor unit such that the first fluid, after being evaporated, flows therethrough;

a fourth connection pipe connected to the first intermediate heat exchanger and provided with a first expansion valve;

first, second, and third outdoor-unit connection pipes connected to the outdoor unit;

a bypass pipe connecting the first connection pipe to the third connection pipe; and a bypass valve provided in the bypass pipe to open or close the bypass pipe, wherein the first outdoor-unit connection pipe is connected to the first connection pipe, wherein the second outdoor-unit connection pipe is connected to the third connection pipe, wherein the third outdoor-unit connection pipe is connected to the fourth connection pipe, wherein, during a cooling operation of the indoor unit, the first fluid is condensed in the outdoor unit and evaporated in the first intermediate heat exchanger through the fourth connection pipe, and wherein, during the cooling operation of the indoor unit, the bypass valve is opened to allow a flow of the first fluid in the first connection pipe to the third connection pipe.

* * * * *